US007546643B1

(12) United States Patent
De La Rotta

(10) Patent No.: US 7,546,643 B1
(45) Date of Patent: Jun. 16, 2009

(54) MECHANICALLY ENHANCED SELF-DONNING GOWN

(76) Inventor: Jorge Enrique De La Rotta, 2430 Wellington Green Dr., #109, Wellington, FL (US) 33414

( * ) Notice: Subject to any disclaimer, the term of this patent is extended or adjusted under 35 U.S.C. 154(b) by 0 days.

(21) Appl. No.: 12/221,985

(22) Filed: Aug. 8, 2008

(51) Int. Cl.
*A41D 13/12* (2006.01)

(52) U.S. Cl. ..... 2/51; 2/114

(58) Field of Classification Search ..... 2/51, 2/114, 455–457, 467, 44–46, 48, 52, 57, 2/69, 79, 83, 85, 88, 89, 92–94, 101, 113, 2/300, 301, 323–330, 332–334, 336, 243.1, 2/255, 256; 128/849, 851, 852, 855, 856, 128/869, 870, 873–875
See application file for complete search history.

(56) References Cited

U.S. PATENT DOCUMENTS

| | | | | | |
|---|---|---|---|---|---|
| 2,583,225 | A * | 1/1952 | Murphy, Jr. | ..... | 2/255 |
| 2,903,706 | A * | 9/1959 | Alberts et al. | ..... | 2/215 |
| 3,359,569 | A * | 12/1967 | Scrivens et al. | ..... | 2/114 |
| 3,721,999 | A * | 3/1973 | Goya et al. | ..... | 2/114 |
| 3,976,066 | A * | 8/1976 | McCartney | ..... | 128/889 |
| 4,523,335 | A * | 6/1985 | Scrivens | ..... | 2/51 |
| 5,003,971 | A * | 4/1991 | Buckley | ..... | 602/54 |
| 5,097,534 | A * | 3/1992 | Viemeister et al. | ..... | 2/114 |
| 5,101,837 | A * | 4/1992 | Perrin | ..... | 128/888 |
| 5,113,526 | A * | 5/1992 | Wang et al. | ..... | 2/2.5 |
| 5,862,525 | A * | 1/1999 | Tankersley et al. | ..... | 2/243.1 |
| 7,093,304 | B2 | 8/2006 | Griesbach, III | | |
| 2005/0044608 | A1 | 3/2005 | Ambrose et al. | | |
| 2006/0117452 | A1 * | 6/2006 | Ambrose | ..... | 2/51 |

* cited by examiner

*Primary Examiner*—Amy B Vanatta

(57) ABSTRACT

The present invention relates to mechanical self-donning gowns that permit the wearer to don the gown without the assistance of another person while ensuring that the sterility of the gown and the hands of the wearer of the gown are not compromised during the donning process. The present invention comprises essentially of a gown body, a closure element attached to the gown body, and a mechanical self-donning mechanism also attached to the gown body. The wearer dons the gown by placing one arm in each sleeve and moving the sleeves so that the mechanical donning mechanisms are moved from the initial closed configurations to a subsequent open configurations thereby engaging the gown closure element and forming the closable back portion of the gown body thereby permitting the wearer to don the gown without the assistance of another person while maintaining a sterile environment.

8 Claims, 6 Drawing Sheets

MECHANICALLY ENHANCED SELF-DONNING GOWN

BACKGROUND

The present invention relates to gowns and other garments, specifically to surgical gowns. Specifically the present invention relates to mechanically enhanced self-donning gowns that permit the wearers to don the gown without the assistance of others while ensuring that the sterility of the gown and the hands of the wearers of the gown are not compromised during the donning process.

The inventor is a medical surgeon with 15 years experience who understands and appreciates the importance of maintaining a sterile environment in the operating room. A sterile surgical environment is of paramount importance in order to limit the possibility of infection and other complications; for this reason, surgeons have long since worn traditional surgical gowns and limited the number persons in the operation room when performing operations on patients.

The traditional surgical gown is sterile, delivered in a sterilized package, and requires the assistance of another in order for the wearer to don the gown. This is so because the traditional surgical gown has an opening in the back of the gown that can only be closed from behind. As the back of the gown is outside the region typically referred to as the "sterile zone" the wearer of the gown cannot reach behind to close the gown without the assistance of others as doing so would require the wearer to reach behind and place her hands in a non-sterile environment thereby defeating the purpose of wearing a sterilized gown in the first place.

As such, a disadvantage of using a traditional surgical gown is that an additional person is needed to don the gown, this not only crowds an already congested area, but it requires the person donning the gown to use precious time that could be directed to the patient's needs.

In order to address the problems of the traditional surgical gown, the inventor invented the present invention, specifically a mechanically enhanced self-donning gown that permits the wearer to don the gown without the assistance of another person while ensuring that the sterility of the gown and the hands of the wearer of the gown are not compromised during the donning process. The present invention comprises essentially of a gown body, a closure element, and a mechanical self-donning mechanism.

An objective of the present invention, is to provide a gown that can be donned without the assistance of another person.

Another objective of the present invention, is to provide a gown that can be donned without the wearer of the gown to place her hands outside the "sterile zone."

Another objective of the present invention, is to provide a gown that can be donned in a time efficient manner.

Yet a further objective of the present invention, is to provide a self-donning gown that is cost efficient to produce.

For the foregoing reasons there exists a need for a mechanically enhanced self-donning gowns that permits the wearer to don the gown without the assistance of another person while ensuring that the sterility of the gown and the hands of the wearer of the gown is not compromised during the donning process.

SUMMARY

The present invention relates to mechanically enhanced self-donning gowns that permit the wearer to don the gown without the assistance of another person while ensuring that the sterility of the gown and the hands of the wearer of the gown is not compromised during the donning process. The present invention comprises essentially of a gown body, a closure element attached to the gown body, and a mechanical self-donning mechanism also attached to the gown body.

In use, the wearer dons the self donning gown, by grasping the gown substantially near the top opening at a point between the first sleeve and the second sleeve. By shaking the gown, the gown is moved from its initial folded configuration to a subsequent unfolded configuration. Once the gown is unfolded, the wearer raises her arms and places one arm in the first sleeve and the other arm in the second sleeve of the gown body. By lowering the sleeves so that the sleeves are substantially parallel to the wearer's body and then raising the sleeves so that the sleeves are parallel to the ground, the mechanical donning mechanisms are moved from the initial closed configurations to subsequent open configurations. Once the mechanical donning mechanisms are in the open configurations, the wearer, by moving the sleeves of the gown body in a forward and back motion, engages the gown closure element thereby forming the closable back portion of the gown body.

DRAWINGS

These and other features, aspects, and advantages of the present invention will become better understood with regard to the following description, appended claims and drawings where:

DESCRIPTION

Figure 1:
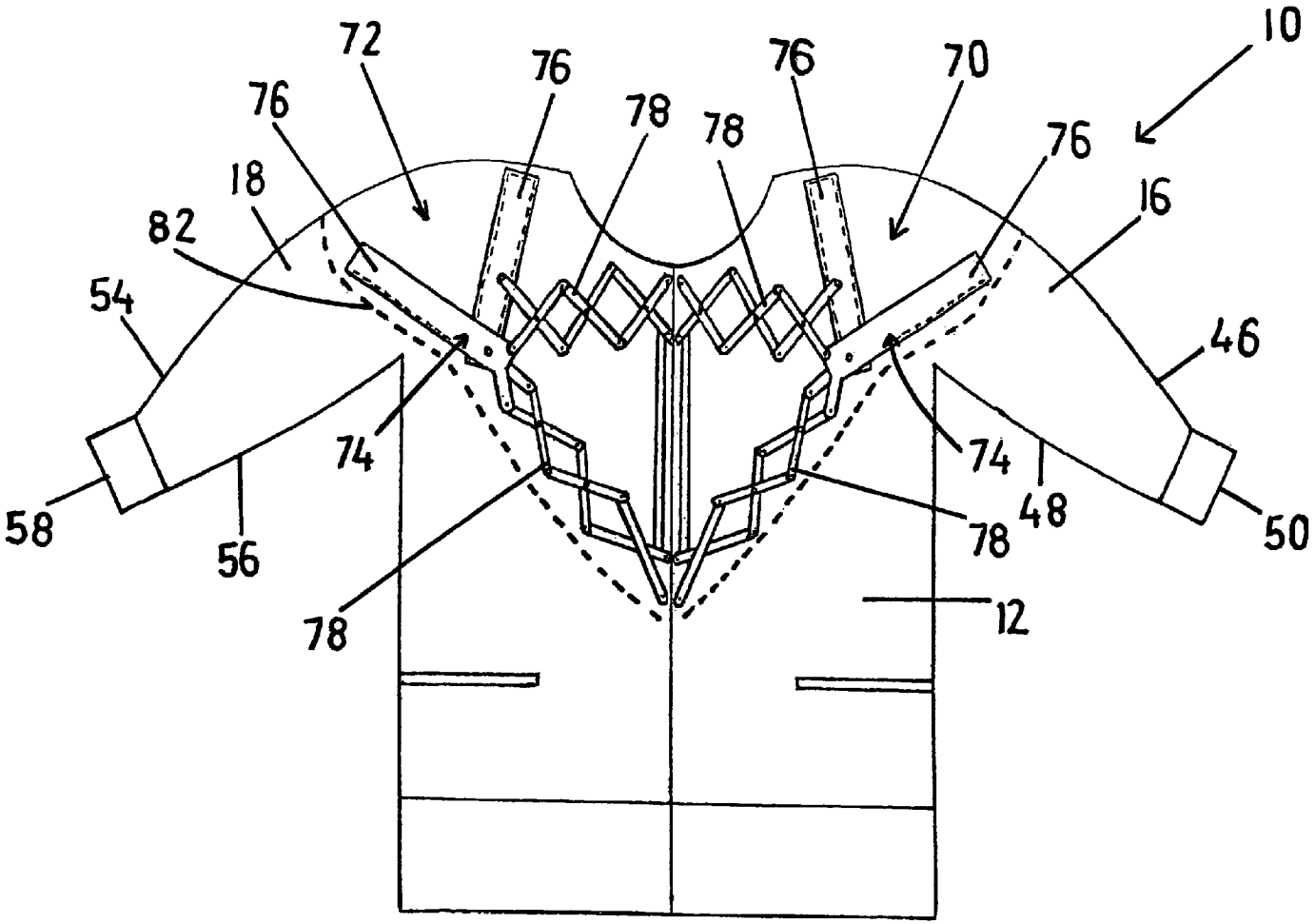
FIG. 1 shows a top plan view of the back of one embodiment of the self-donning gown in the closed position.
Figure 2:
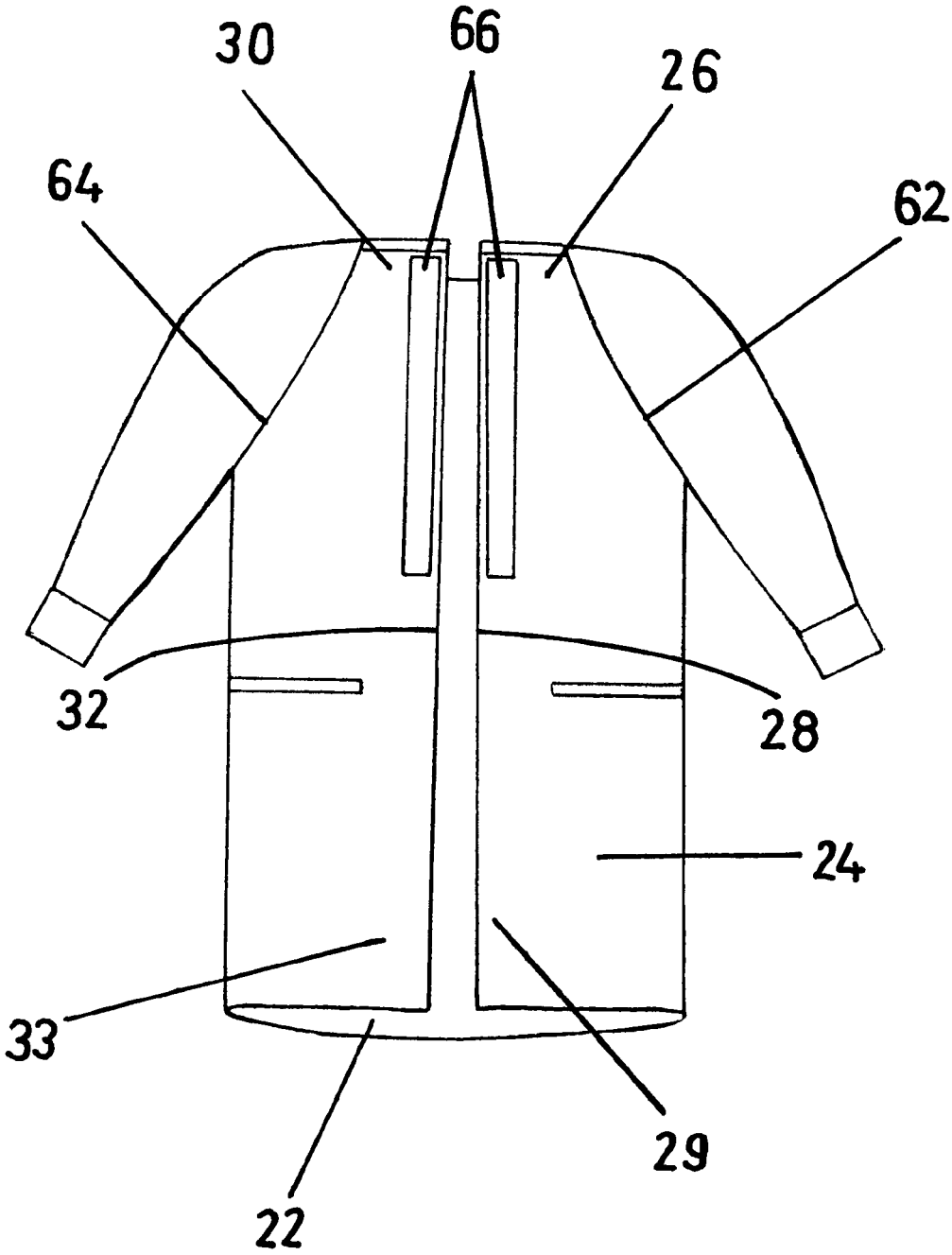
FIG. 2 shows a top plan view of the back of one embodiment of the self-donning gown in a substantially closed position.
Figure 3:
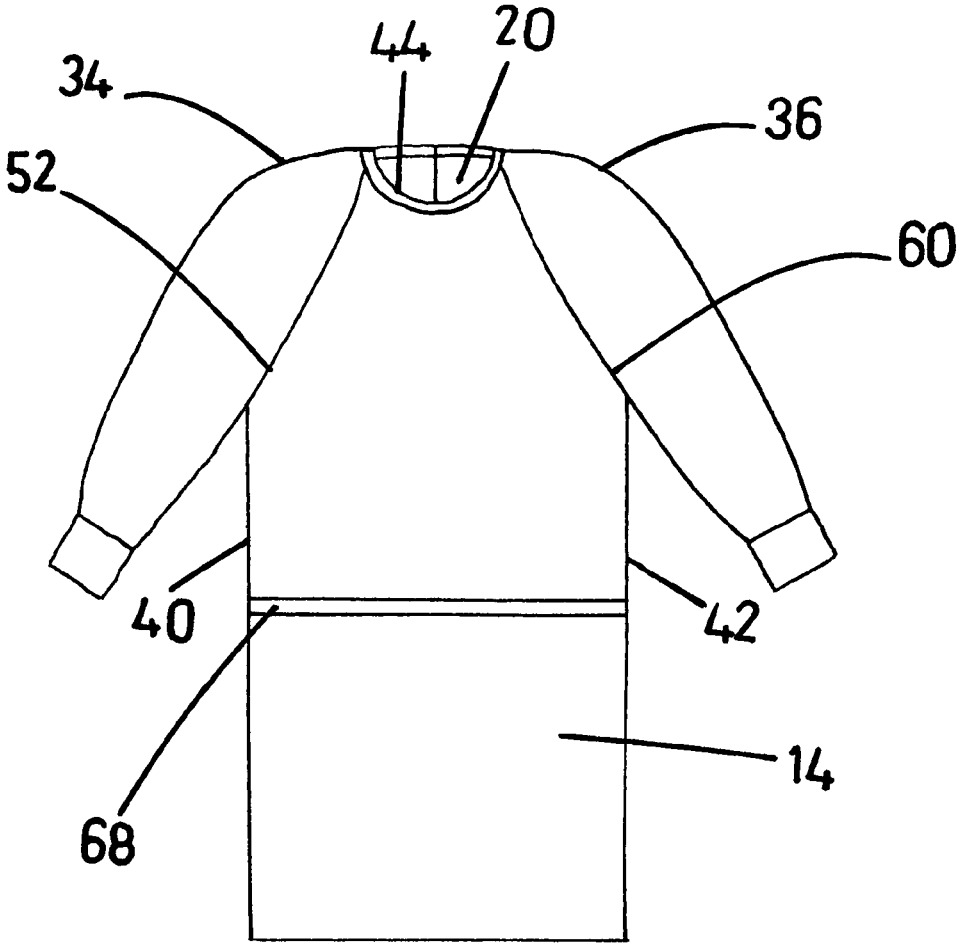
FIG. 3 shows a top plan view of the front of one embodiment of the self-donning gown in the closed position.
Figure 4:
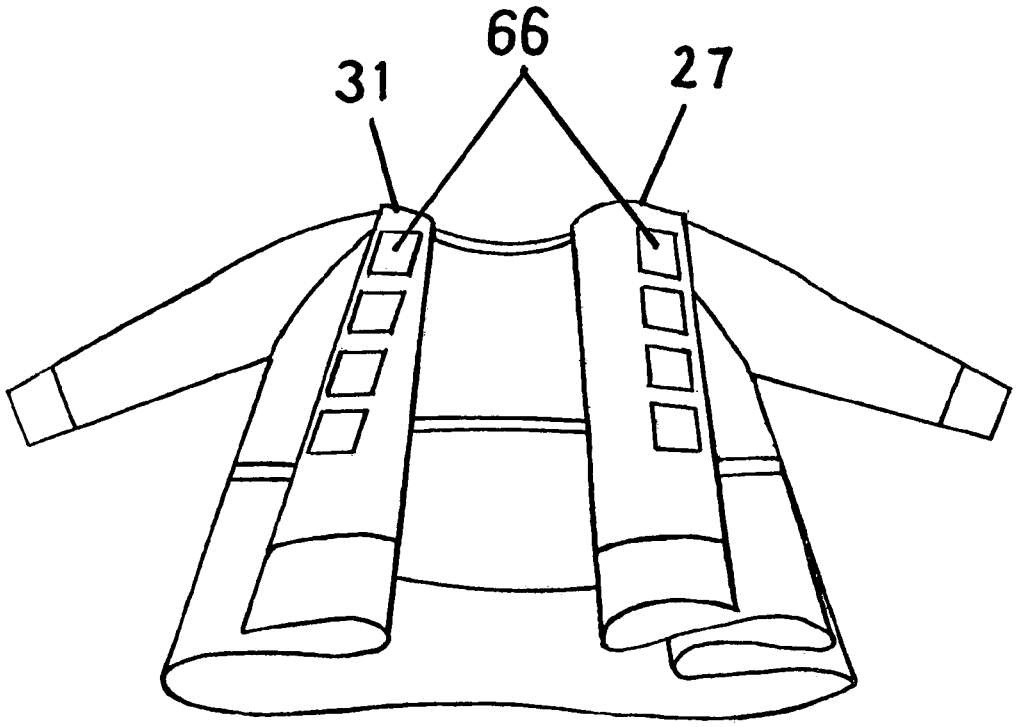
FIG. 4 shows a top plan view of the back of one embodiment of the self-donning gown in a substantially open position.

As shown in FIGS. 1-4, one embodiment of a self-donning gown 10 is depicted. The self-donning gown 10 comprises a gown body 12, the gown body comprises a closed front portion 14, a first sleeve 16, a second sleeve 18, a top opening 20, a bottom opening 22, and a closable back portion 24 having a first back side 26 with a first back edge 28 and a second back side 30 with a second back edge 32 that when overlapped forms the closable back portion 24 of the gown. The gown body 12 may be composed of a single continuous sheet of paper-like or cotton-like material or alternatively the gown body 12 may be composed of a plurality of sheets of material, whereby each sheet of material is sewn together or attached by other means known in the art.

The closed front portion 14 is defined by upper edges 34 and 36, a bottom edge 38, a first side edge 40 and a second side edge 42. The top opening 20, defined by top opening edge 44, may be formed generally between upper edges 34 and 36. The bottom opening 22 is defined by bottom edge 38.

The first sleeve 16 is defined by first upper sleeve edge 46, first lower sleeve edge 48, and first sleeve opening 50. The first sleeve 16 adjoins the closed front portion 14 at a junction between the first side edge 40 and the first lower sleeve edge 48 as well as at a junction between the upper edge 34 and first upper sleeve edge 46. In one embodiment of the self-donning gown 10, the attachment of first sleeve 16 with the closed front portion 14 is defined by first seam 52.

The second sleeve 18 is defined by second upper sleeve edge 54, second lower sleeve edge 56, and second sleeve opening 58. The second sleeve 18 adjoins the closed front portion 14 at a junction between the second side edge 42 and the second lower sleeve edge 56 as well as at a junction between the upper edge 36 and second upper sleeve edge 54. In one embodiment of the self-donning gown 10, the attachment of second sleeve 18 with the closed front portion 14 is defined by second seam 60.

The closable back portion 24, having a first back side 26 having an inner surface 27 and an outer surface 29 and second back side 30 having an inner surface 31 and an outer surface 33, is generally defined by upper edges 34 and 36, a bottom edge 38, a first side edge 40 and a second side edge 42, a first back edge 28 and a second back edge 32. The top opening 20, defined by top opening edge 44, may be formed generally between upper edges 34 and 36. The bottom opening 22 is defined by bottom edge 38. The first back side 26 adjoins the first sleeve 16 at a junction between the first side edge 40 and the first lower sleeve edge 48 as well as at a junction between the upper edge 34 and first upper sleeve edge 46. In one embodiment of the self-donning gown 10, the attachment of first sleeve 16 with the first back side 26 is defined by third seam 62. The second back side 30 adjoins the second sleeve 18 at a junction between the second side edge 42 and the second lower sleeve edge 56 as well as at a junction between the upper edge 36 and second upper sleeve edge 54. In one embodiment of the self-donning gown 10, the attachment of second sleeve 18 with the second back side 30 is defined by fourth seam 64.

A gown closure element 66 may be disposed adjacent to the first back edge 28 along the outer surface 29 and inner surface 27 as well as adjacent to the second back edge 32 along the outer surface 33 and inner surface 31. The gown closure element may be composed of hook and loop material or other fastener material known in the art.

The gown body 12 may also include a gown shaping member 68 to configure the self-donning gown 10 to the contours of the gown wearer's body. The gown shaping member 68 may be positioned on the gown body 12 in between the top opening 20 and the bottom opening 22 in an orientation parallel to bottom edge 38. The gown shaping mechanism 68 may be in the shape of a band and may be composed of elastic or another material known in the art having elastic qualities.

A first mechanical donning mechanism 70 and a second mechanical donning mechanism 72, each mechanical donning mechanism 70 and 72 comprises at least one hinged extension mechanism 74 wherein each hinged extension mechanism 74 further comprises at least one lever member 76 and at least two extension members 78 configured in a scissor-like manner, the first mechanical donning mechanism 70 is attached to the gown body 12 at a point in between the first sleeve 16 and the first back edge 28 and the second mechanical donning mechanism 72 is attached to the gown body 12 at a point in between the second sleeve 18 and the second back edge 30. The mechanical donning mechanisms 70 and 72 further comprises an elastic band 80 that is attached to the terminal extension member 78 of each hinged extension mechanism 74. The mechanical donning mechanisms 70 and 72 may be composed of polypropane or another light weight, flexible, plastic material known in the art with similar qualities. In one embodiment the mechanical donning mechanisms 70 and 72 are positioned within a pocket 82 of the gown body 12.

Figure 5:
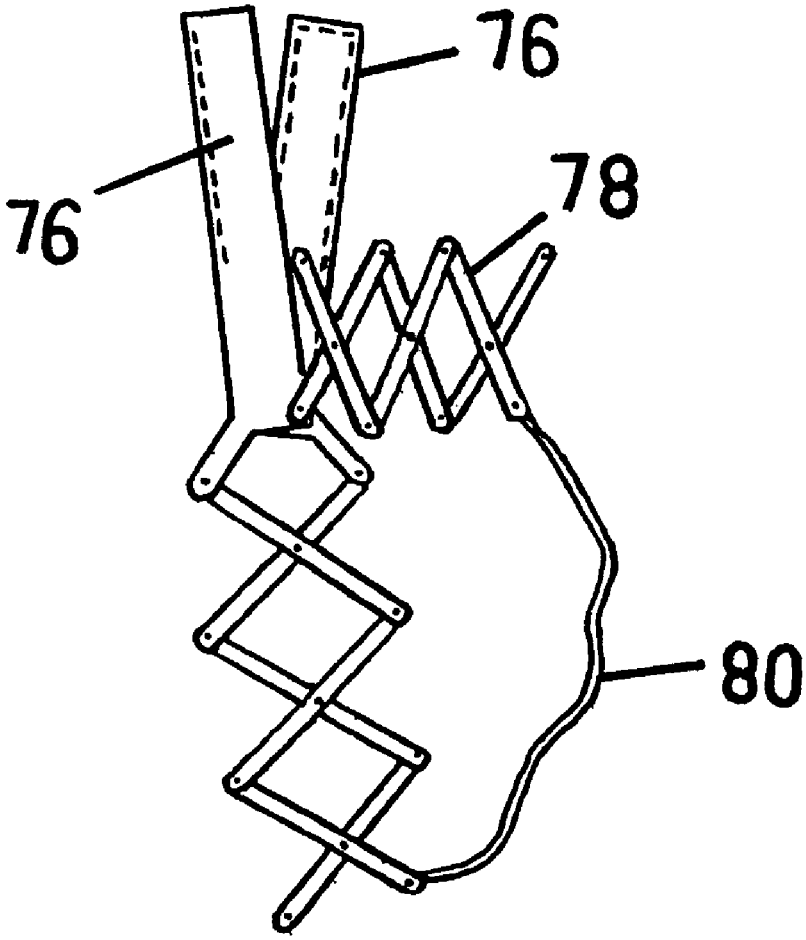
FIG. 5 shows a top plan view of one embodiment of the mechanical donning mechanism in a substantially closed position.
Figure 6:
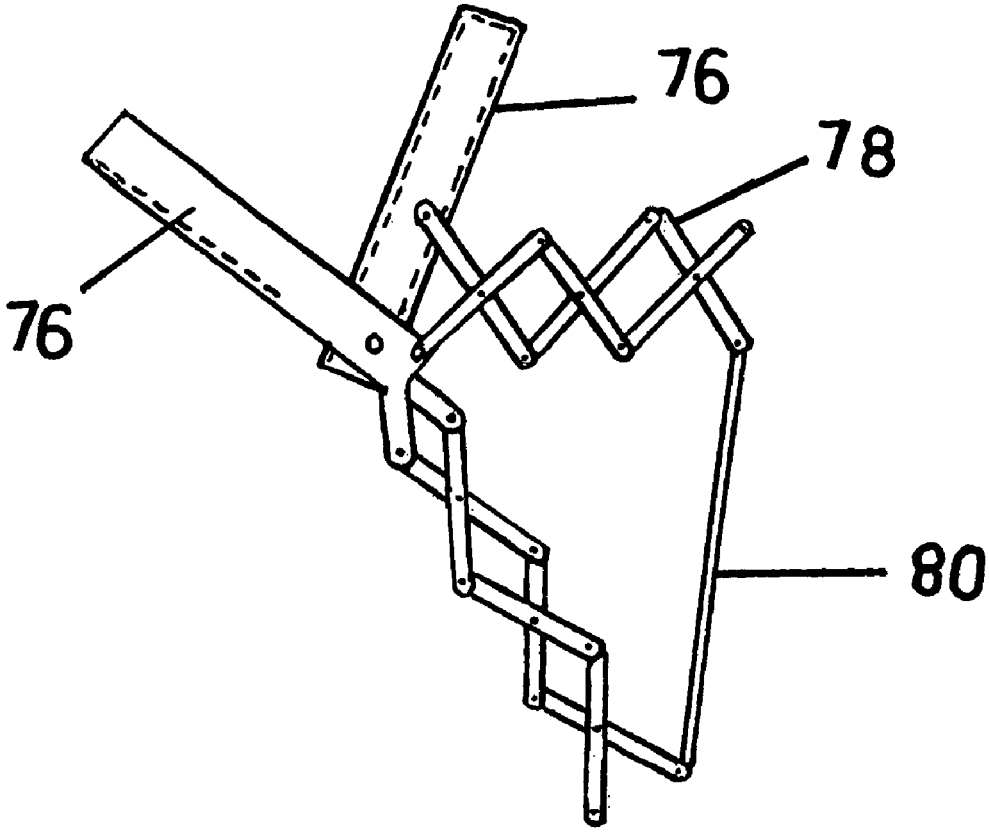
FIG. 6 shows a top plan view of one embodiment of the mechanical donning mechanism in a substantially open position.

In use, the wearer dons the self donning gown 10, by grasping the gown 10 substantially near the top opening 20 at a point between the first sleeve 16 and the second sleeve 18. By shaking the gown 10, the gown 10 is moved from its initial folded configuration to a subsequent unfolded configuration. Once the gown 10 is unfolded, the wearer raises her arms and places one arm in the first sleeve 16 and the other arm in the second sleeve 18 of the gown body 12. By lowering the sleeves 16 and 18 so that the sleeves 16 and 18 are substantially parallel to the wearer's body and then raising the sleeves 16 and 18 so that the sleeves 16 and 18 are parallel to the ground, the mechanical donning mechanisms 70 and 72 are moved from the initial closed configurations (see FIG. 5) to subsequent open configurations (see FIG. 6). Once the mechanical donning mechanisms 70 and 72 are in the open configurations, the wearer, by moving the sleeves 16 and 18 of the gown body 12 in a forward and back motion, engages the gown closure element 66 thereby forming the closable back portion 24 of the gown body 12.

By donning the self donning gown 10 as described, the wearer can don a gown without the need of assistance of another in a time effective manner while maintaining a sterile environment as the wearer's hands never leave the "sterile zone."

The term "sterile zone" is generally understood by those in the field to refer to the region generally in front of a gown wearer's body beginning substantially near to the wearer's neckline and extending substantially to the wearer's waist line; the "sterile zone" is also generally understood to extend laterally outward to the sides of the wearer's body.

An advantage of the present invention is that it provides a gown that can be donned without the assistance of another person.

Another advantage of the present invention is that it provides a gown that can be donned without the wearer of the gown to place her hands outside the "sterile zone."

Another advantage of the present invention is that it provides a gown that can be donned in a time efficient manner.

Yet still another advantage of the present invention is that it provides a self-donning gown that is cost efficient to produce.

Although the present invention has been described in considerable detail with reference to certain preferred versions thereof, other versions are possible. Therefore, the spirit and the scope of the claims should not be limited to the description of the preferred versions contained herein.

What is claimed is:

1. A self donning gown comprising:

a gown body, the gown body comprises a closed front portion, a first sleeve, a second sleeve, a top opening, a bottom opening, and a closable back portion having a first side with a first edge and a second side with a second edge that when overlapped forms the closable back portion of the gown;

a gown closure element disposed along the edges of the sides of the gown body;

a first mechanical donning mechanism and a second mechanical donning mechanism, each mechanical donning mechanism comprising at least one hinged extension mechanism wherein each hinged extension mechanism further comprises at least one lever member and at least two extension members configured in a scissor-like manner, the first mechanical donning mechanism is disposed on the gown body at a point in between the first sleeve and the first edge of the gown body and the second mechanical donning mechanism is disposed on the gown body at a point in between the second sleeve and the second edge of the gown body.

2. The gown of claim 1, wherein the gown body further comprises a gown shaping member to configure the gown to the contours of the gown wearer's body.

3. The gown of claim 2, wherein the gown shaping member is a band made of a material having elastic qualities.

4. The gown of claim 3, wherein the mechanical donning mechanisms are composed of a light weight flexible plastic material.

5. The gown of claim 4, wherein the mechanical donning mechanisms are positioned within a pocket of the gown body.

6. The gown of claim 5, wherein the gown closure element is composed of a hook and loop material.

7. A method for donning the self donning gown of claim 1 comprising the steps of:

providing the gown;

grasping the gown substantially near the top opening at a point between the first sleeve and the second sleeve;

shaking the gown so that the gown is moved from its initial folded configuration to a subsequent unfolded configuration;

raising the wearer's arms and placing one arm in the first sleeve and the other arm in the second sleeve of the gown body;

lowering the sleeves of the gown body so that the sleeves are substantially parallel to the wearer's body and then raising the sleeves so that the sleeves are substantially parallel to the ground so that the mechanical donning mechanisms are moved from the initial closed configurations to a subsequent open configuration; and moving the sleeves of the gown body in a forward and back motion so that the gown closure element is engaged thereby forming the closable back portion of the gown.

8. A method for donning the self donning gown of claim 6 comprising the steps of:

providing the gown;

grasping the gown substantially near the top opening at a point between the first sleeve and the second sleeve;

shaking the gown so that the gown is moved from its initial folded configuration to a subsequent unfolded configuration;

raising the wearer's arms and placing one arm in the first sleeve and the other arm in the second sleeve of the gown body;

lowering the sleeves of the gown body so that the sleeves are substantially parallel to the wearer's body and then raising the sleeves so that the sleeves are substantially parallel to the ground so that the mechanical donning mechanisms are moved from the initial closed configurations to a subsequent open configuration; and moving the sleeves of the gown body in a forward and back motion so that the gown closure element is engaged thereby forming the closable back portion of the gown.

* * * * *